US006129144A

United States Patent [19]

Bousquet

[11] Patent Number: 6,129,144

[45] Date of Patent: Oct. 10, 2000

[54] EVAPORATOR WITH IMPROVED HEAT-EXCHANGER CAPACITY

[75] Inventor: Frédéric Bousquet, Le Mans, France

[73] Assignee: Valeo Climatisation, La Verriere, France

[21] Appl. No.: 09/175,257

[22] Filed: Oct. 20, 1998

[30] Foreign Application Priority Data

Oct. 20, 1997 [FR] France ..... 97 13117

[51] Int. Cl.[7] ..... F28D 1/04

[52] U.S. Cl. ..... 165/153; 165/176; 165/166; 165/DIG. 466

[58] Field of Search ..... 165/152, 153, 165/148, 176

[56] References Cited

U.S. PATENT DOCUMENTS

| | | | |
|---|---|---|---|
| 3,976,128 | 8/1976 | Patel et al. | 165/153 |
| 4,217,953 | 8/1980 | Sonoda et al. | 165/44 |
| 4,274,482 | 6/1981 | Sonada | 165/153 |
| 5,318,114 | 6/1994 | Sasaki | 165/176 |
| 5,544,702 | 8/1996 | Nishishita | 165/153 |
| 5,562,158 | 10/1996 | Nishishita | 165/153 |
| 5,617,914 | 4/1997 | Kinugasa et al. | 165/153 |
| 5,810,077 | 9/1998 | Nakamura et al. | 165/153 |

FOREIGN PATENT DOCUMENTS

| | | | |
|---|---|---|---|
| 0 661 508 | 7/1995 | European Pat. Off. . | |
| 0 702 201 | 3/1996 | European Pat. Off. . | |
| 61-55596 | 3/1986 | Japan | 165/153 |
| 4-309766 | 11/1992 | Japan | 165/153 |

OTHER PUBLICATIONS

French Search Report dated Jul. 3, 1998.

*Primary Examiner*—Ira S. Lazarus
*Assistant Examiner*—Terrell McKinnon
*Attorney, Agent, or Firm*—Morgan & Finnegan LLP

[57] ABSTRACT

An evaporator consisting of stacked pockets wherein the refrigerating fluid is injected into an upstream connecting duct formed by a sub-assembly of the pockets by a longitudinal tubing which passes through an end face of the evaporator, distant from the upstream connecting duct, and at least another connecting duct formed by other pockets. According to the invention, the tubing is offset with respect to the centers of the openings through which the pockets forming the other connecting duct communicate between them. This results in an improvement in the heat exchange efficiency. The invention is applicable to the air conditioning of the passenger space of automobile vehicles.

17 Claims, 2 Drawing Sheets

EVAPORATOR WITH IMPROVED HEAT-EXCHANGER CAPACITY

FIELD OF THE INVENTION

The invention relates to a heat exchanger for exchanging heat between a first and second fluid, comprising a stack of small pockets which are mutually aligned in a longitudinal direction, and which form two collector casings which are mutually juxtaposed in a lateral direction, the said pockets each being formed, through their alignment, in the longitudinal direction, by input and output chambers which are respectively part of different pockets, the collector casings being sub-divided, as a whole, into at least three connection conduits, the conduits belonging to one same collector casing, disposed one after the other in the longitudinal direction and not connected directly with each other, while, in each connection conduit, the input or output chambers are mutually connected via openings in the walls of the pockets, the pockets defining a course, for the first fluid, between an upstream connection conduit adjacent to a first longitudinal end of the stack, and a downstream connection conduit adjacent to the second longitudinal end of the stack, passing, alternately, via U-shaped courses, each of which connect the input and output chambers of one same pocket, from a connection conduit, which is part of one of the collector casings, to a connection conduit which is part of the other collector casing, the upstream and downstream connection conduits being connected to input and output passages provided in one of the said longitudinal ends, the one directly and the other via tubing across the openings of the connection conduit or conduits which are located between this same end and the said other connection conduit.

BACKGROUND OF THE INVENTION

Heat exchangers of this kind are normally used as evaporators in air-conditioning devices for the interior compartment of vehicles. The pockets are each formed by two sheet-metal plates with recessed edge regions, the concavities of which face each other and are connected to each other, at their periphery, with a seal, the input and output chambers being delimited by areas of the recesses of greater depth than the remaining areas, such that, between two adjacent pockets of the said remaining areas, there is a gap for the passage of the second fluid in the lateral direction, the said openings being provided at the bases of the recesses, which are in mutual sealed contact around the openings. The two recesses of each pocket are furthermore connected with a seal in a central are of their breadth and over an appreciable portion of their length, starting from a first end rim, the two sides of the said U-shaped course extending on both sides of the said median area, such that the said areas of greater depth of the recesses are arranged adjacent to the said first end rim.

The object of the invention is to improve the operational characteristics of these evaporators.

SUMMARY OF THE INVENTION

The invention is particularly armed at producing a heat-exchanger of the kind defined above, and provides for the eccentric location of the said tubing in relation to the said openings.

It should be noted that the fact that the tubing is placed in an eccentric position, rather than in a centred one, improves both the overall efficiency of heat-exhange and the uniformity of this in the body of the exchanger, and thus improves the uniformity of the temperature of the air coming from the outlet of the evaporator.

Optional, supplementary or alternative, characteristics of the invention are stated below:

The connection conduits are equal in number in the two collector casings, the upstream and downstream connection conduits forming part of two respective collector casings.

The said openings are elongated and the tubing is offset, in relation to the centres of the openings, in the direction of their length.

The said openings are elongated in the lateral direction, and the tubing is offset, in relation to the centres of the openings, towards the outside of the exchanger.

The tubing is in contact with the edge of each opening, approximately at the point of the latter which is furthest away from the centre, in particular.

The tubing is in contact with the edge of each opening, approximately semi-circular section of the edge of the opening.

The tubing supplies the upstream connection conduit.

The tubing is brazed at the edges of the openings. In this case, a rigid connection of the tubing and the pockets, which reduces the noise emitted by the exchanger as a result of vibrations and the flowing of the fluid, is obtained.

The longitudinal and lateral directions are substantially horizontal, the collector casings being disposed on the upper part of the exchanger.

The characteristics and advantages of the invention will be explained, with reference to the accompanying drawings in greater detail in the description below.

DESCRIPTION OF THE PREFERRED EMBODIMENTS OF THE INVENTION

Figure 1:
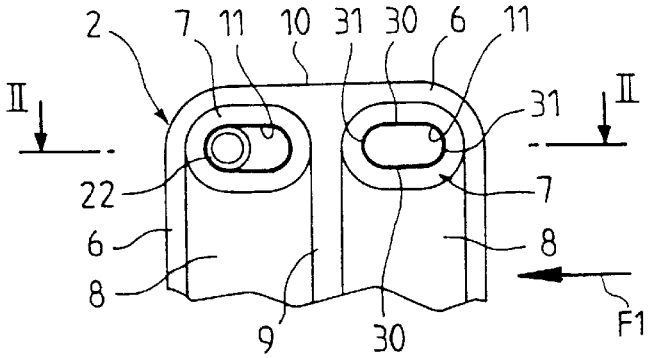
FIG. 1 is a partial, sectional view, of an evaporator in accordance with the invention, along the line I—I as shown in FIG. 2.

The evaporator shown which is intended for use in an air-conditioner of the interior compartment of a motor vehicle, comprises a number of small pockets 1, which are attached one on another in an approximately horizontal direction, and which are each formed of two sheet-metal plates and pressed to produce bowl-shaped recesses 2 and 3. The recesses are respectively identical and their concavities face each other, that is, towards the second and first longitudinal ends 5, 4 of the stack, respectively. Each recess has a peripheral edge 6 positioned in a vertical plane, and the peripheral rims 6 of the two recesses, forming a small pocket, are attached to each other so as to form a fluid seal, by brazing, to delimit the internal volume of the pocket. Each pocket further has, on its upper part, two areas 7 of greater depth than that of the remaining area 8, this latter area occupying the major part of the height of the recess, below the areas 7. These two areas of greater depth of each recess, juxtaposed from left to right in the diagrams, define in each pocket an input and output chamber for the coolant fluid. The input and output chamber, of each pocket, are separated from each other by a sealed joint 9 between the two recesses, half way up the pocket, this joint being connected to the edge 6 at the upper end 10 of the pocket and being extended downwards to a point close to the lower end of the pocket, such that, in relation to areas 8 of the recesses, a U-form course is defined, in this pocket, for the fluid, between the input and output chambers. The base of each recess is crossed, in each of the areas 7 of greater depth, by an opening 11, and the bases facing each other, of one recess 2 and an adjacent recess 3, are connected to each other with a seal around the openings, by brazing.

The alignment of the input/output chambers, located on the left-hand side of the figures forms a collector casing 16, and the alignment of the input/output chambers, located on the right-hand side, forms a collector casing 17. The collector casing 16 is sub-divided, by a transverse partition 18, into a connection conduit 12, extending from this partition to the end 4 of the stack, and a connection conduit 14 which extends from the partition to the end 5. Likewise, a transverse partition 19, which is further away from the end 4 than is the partition 18, separates the collector casing 17 into a connection conduit 13, next to the end 4, and a connection conduit 15, which is next to the end 5. End plates 20 and 21 are brazed at the bases of the recesses 2, 3, located at the ends 4, 5, respectively, of the stack of pockets, such that the openings 11 of these recesses is sealed, and these end plates contribute to the delimitation of the connection conduits. The input/output chambers, which form one same connection conduit, connect with each other through the openings 11 of the recesses 2, 3.

Input tubing 22 extends along the whole length of the connection conduit 14 and passes in a sealed manner through the end plate 21 and the intermediate partition 18, to which it is brazed, such that the connection conduit 12 connects with the part of the coolant fluid circuit positioned upstream of the evaporator. Output tubing 23 similarly passes through the plate 21 and opens into the connection conduit 15, such that the latter is connected with the downstream section of the circuit.

The coolant fluid entering the connection conduit 12, by the tubing 22, then passes into the connection conduit 13, following, at the same time, the U-form courses of a first set of pockets. It is then transferred to the connection conduit 14, via the U-shaped shaped courses of a second set of pockets, then to connection conduit 15, via U-shaped pathways of a third and final set of pockets. The fluid finally leaves the evaporator through the tubing 23. During circulation in the U-shaped pathways, the fluid absorbs heat from a flow of air which passes through the evaporator horizontally, from the right to left, as indicated by arrow F1, passing through the gaps which separate the pockets with respect to the areas 8 of the recesses.

In accordance with the invention, tubing 22 is offset in relation to the centres of openings 11 of the recesses which define the collector casing 16. In the example shown, the tubing is offset towards the left that is, in relation to the flow of the air F1, offset towards the downstream side. More particularly, the outline of each opening 11 is oval in form and is made up of two horizontal, straight sections 30 and two semi-circles 31, the hollows of which face each other and are tangential to sections 30. The tubing 22 has an outer diameter, which is equal in size to the diameter of the semi-circles 31, and rests on the rim of the openings which it passes over, and is brazed at this edge, along the whole length of the semi-circle 31 situated on the left-hand side.

As a variation, a diameter of the tubing 22 which is smaller than that of the semi-circles 31, can be envisaged, the point of contact then being substantially coincident.

Figure 3:
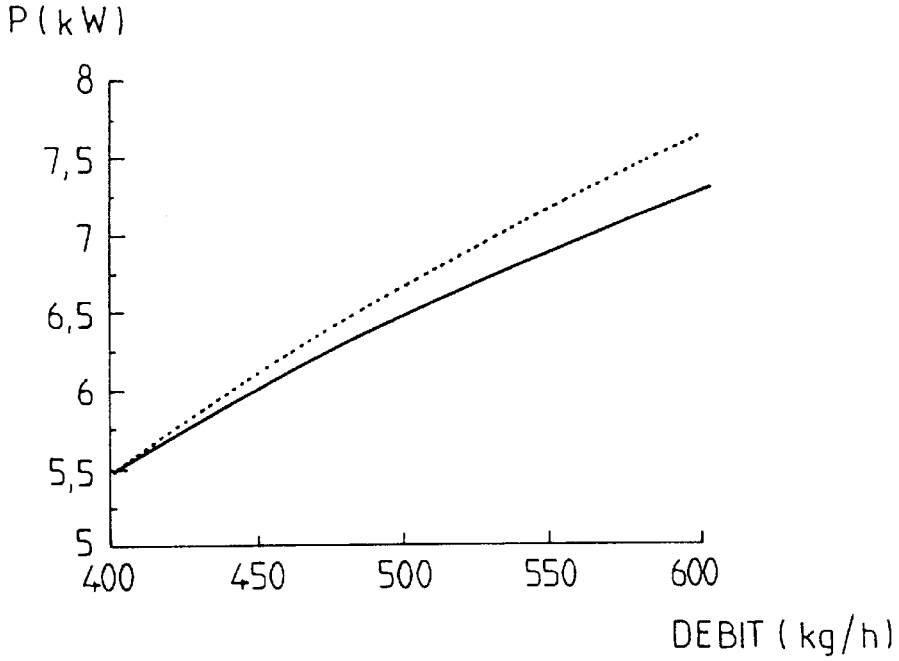
FIGS. 3 and 4 are comparative diagrams showing curves of operational characteristics of the evaporator of FIGS. 1 and 2, and of an evaporator in accordance with the state of the art.
Figure 4:
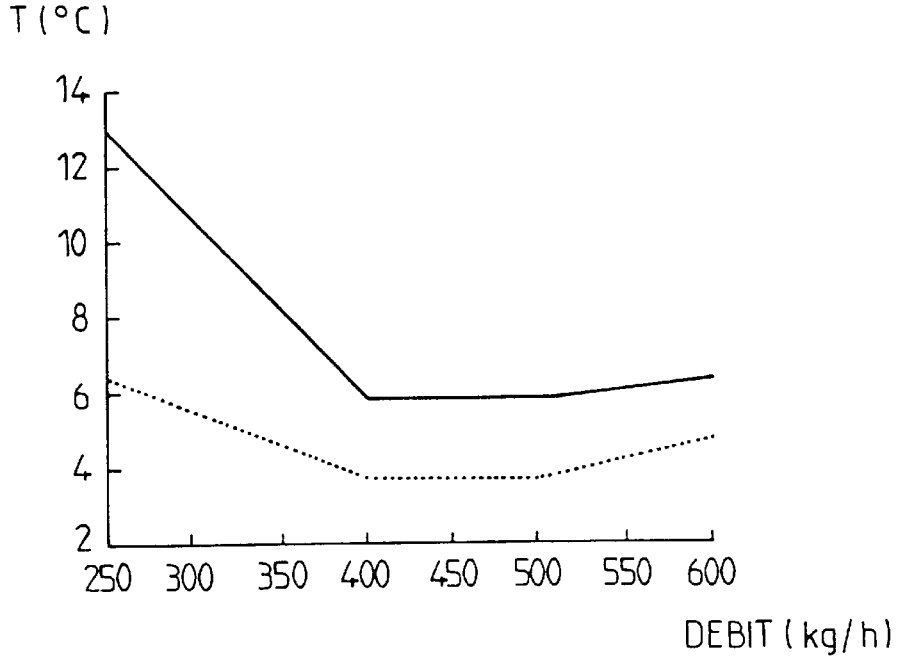

In each of the graphs of FIGS. 3 and 4, the dotted curve and the solid line relate respectively to the evaporator shown and to a different evaporator, differing in that the axis of tubing 22 passes through the centres of the openings which it crosses. The lines of the graphs of FIGS. 3 and 4 show, respectively, the calorific power exchanged in kW, and the temperature of the exiting air in ° C., as a function of airflow in kilograms/hour, passing through the evaporator, the temperature of the air entering being 30° C. As a result of the invention, a significant improvement in the performance of the evaporator is observed.

The improvement in accordance with the invention also improves the uniformity of heat-exchange within the body of the evaporator, and therefore improves the uniformity of temperature distribution within the flow of air coming from the evaporator, with a reduction in the phenomena of hot and cold spots.

Moreover, the brazing of the tubing at the rims of the openings, over a major part of the length of the latter leads to reinforcement of rigidity, and to a reduction in noise resulting from the operation of the evaporator.

Figure 2:
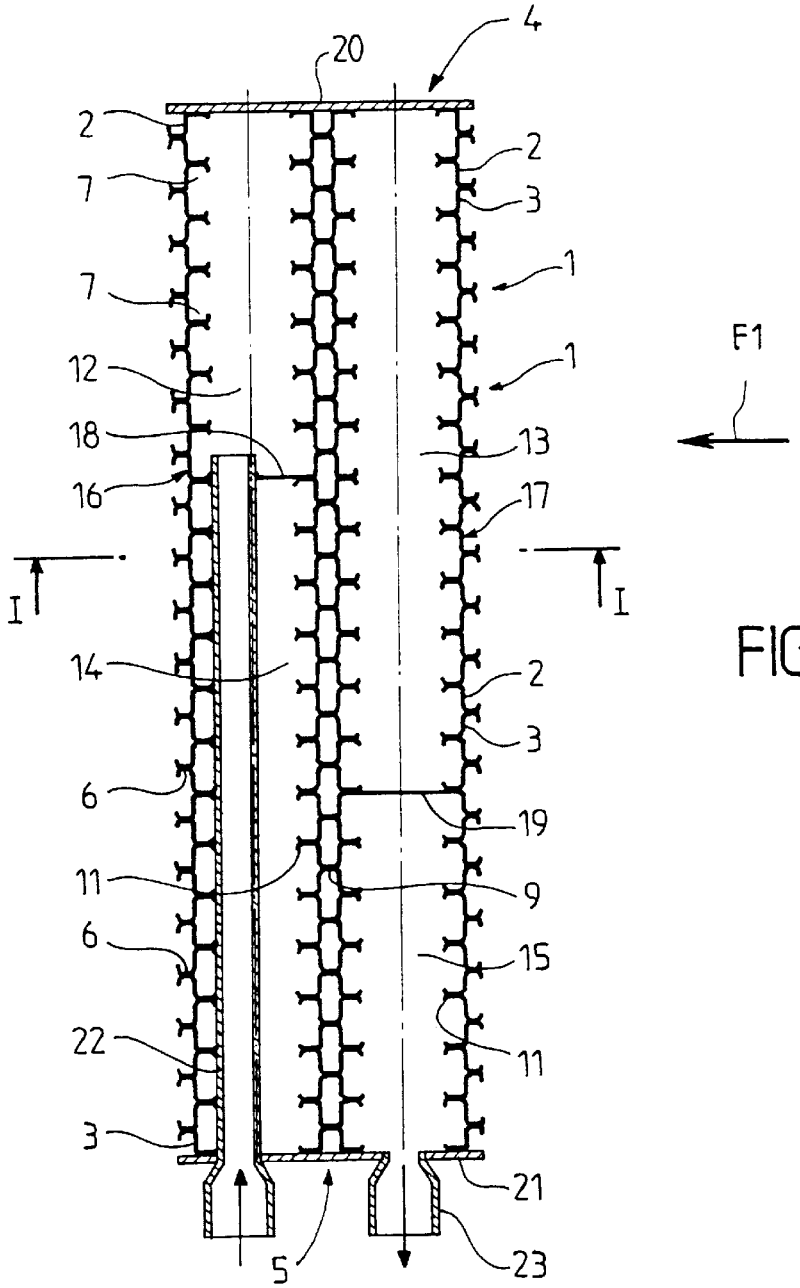
FIG. 2 is a sectional, plan-view of the evaporator, along the line II—II as indicated in FIG. 1.

Even though the particular arrangement described above may produce optimum performance, it is still possible to diverge from this design while benefitting from the invention. Thus, the tubing can be partly offset, in relation to the centres of the openings, without reaching the lateral ends of the said openings. It can be shifted towards the middle of the breadth of the evaporator, rather than towards the outside. It can be offset towards the downstream side, in relation to the flow of air, or can be offset transversely in relation to this. It is not necessarily brazed at the edge of the openings. The tubing offset in accordance with the invention, can be output tubing which is connected to the downstream connection conduit. It is also possible to have an odd number of connection conduits, the intake and output of fluid occurring on the same side of the evaporator, whether left or right, in relation to FIGS. 1 and 2.

The evaporator can also function when orientated differently from the orientation described.

What is claimed is:

1. A heat-exchanger for the exchange of heat between a first and a second fluid, comprising a stack of pockets which are mutually aligned in a longitudinal direction, and which form two collector casings which are mutually juxtaposed in a lateral direction, the pockets each being formed, through their alignment, in the longitudinal direction, by input and output chambers which are respectively part of different pockets, the collector casings collectively being sub-divided into at least three connection conduits, the conduits belonging to the same collector casing being disposed one after the other in the longitudinal direction and not connected directly with each other, in each connection conduit the input or output chambers are mutually connected via openings in the walls of the pockets, the pockets defining a course for the first fluid between an upstream connection conduit adjacent to a first longitudinal end of the stack and a downstream connection conduit adjacent to the second longitudinal end of the stack, passing alternately via U-shaped courses, each of which connect the input and output chambers of one same pocket from a connection conduit which is part of one of the collector casings to a connection conduit which is part of the other collector casing, the upstream and downstream connection conduits being connected to an input and an output passage provided in one of the longitudinal ends, one directly and the other via tubing across the openings of the connection conduit which are located between this same end and the other connection conduit, wherein the tubing is eccentrically located in relation to the openings on the downstream side of the second fluid.

2. A heat-exchanger in accordance with claim 1, wherein the connection conduits are equal in number in the two collector casings, the upstream and downstream connection conduits forming part of two respective collector casings.

3. A heat-exchanger in accordance with claim 1, wherein the openings are elongated and the tubing is offset in relation to the centers of the openings in the direction of their length.

4. A heat-exchanger in accordance with claim 3, wherein the openings are elongated in the lateral direction, and the tubing is offset in relation to the centers of the openings towards the outside of the exchanger.

5. A heat-exchanger in accordance with claim 1, wherein the tubing is in contact with the edge of each opening.

6. A heat-exchanger in accordance with claim 3, wherein the tubing is in contact with the edge of each opening, approximately at the point of the latter which is furthest away from the center.

7. A heat-exchanger in accordance with claim 6, wherein the tubing has a circular cross-section which partly coincides with an approximately semi-circular section of the edge of the opening.

8. A heat-exchanger in accordance with claim 1, wherein the tubing supplies the upstream connection conduit.

9. A heat-exchanger in accordance with claim 1 wherein the tubing is brazed at the edges of the openings.

10. A heat-exchanger in accordance with claim 1 wherein the longitudinal and lateral directions are substantially horizontal, the collector casings being disposed on the upper part of the exchanger.

11. A heat-exchanger in accordance with claim 1, wherein pockets are each formed by two sheet-metal plates with bowl-shaped edge regions, the concavities of these regions facing each other and being connected to each other, at their periphery, in a sealed manner, the input and output chambers being delimited by areas of the edge regions of greater depth than the remaining areas, such that, as regards the remaining areas, and between two adjacent pockets, a gap is reserved for the passage of the second fluid, in the lateral direction, the openings being provided at the bases of the edge regions, which are in reciprocal sealed contact, with each other, around the openings.

12. A heat-exchanger in accordance with claim 11, wherein the two edge regions of each pocket are furthermore connected in a central area of their breadth, and over an appreciable portion of their length, starting from a first end rim, the two sides of the U-shaped course extending on both sides of the said median area, like the said area of greater depth of the edge regions, arranged close to the first end rim.

13. A heat exchanger for an air-conditioning device for an interior compartment of a motor vehicle comprising:

a collector casing formed by a plurality of mutually connected and aligned small pockets; the collector casing defines an opening therein and is sub-divided into at least two connection conduits that are partitioned from one another; and a fluid input tubing inserted in an off-centered position in the opening passing through at least one of the connection conduits.

14. The heat exchanger of claim 13, wherein the tubing is in contact with the opening.

15. The heat exchanger of claim 13, wherein the opening has an approximately elliptical cross-section and the tubing has an approximately circular cross-section, the tubing is offset to coincide with the approximately semi-circular section of the opening.

16. The heat exchanger of claim 13 further comprising two collector casings which are mutually juxtaposed in a lateral direction, and in each connection conduit, a plurality of input or output chambers are mutually formed and connected via openings in the walls of the pockets, the pockets defining a course for a coolant liquid to pass through an upstream connection conduit adjacent to a first longitudinal end of the collector housing, and then down through a downstream connection conduit adjacent to the second longitudinal end of the collector housing, passing through to a connection conduit which is part of a different collector casing.

17. The heat exchanger of claim 16 wherein the tubing supplies a coolant fluid to the upstream connection conduit.

* * * * *